US011624245B2

(12) United States Patent
Olsen

(10) Patent No.: US 11,624,245 B2
(45) **Date of Patent: *Apr. 11, 2023**

(54) COUPLING ASSEMBLY FOR ELONGATE ELEMENTS

(71) Applicant: Torsion Tool Company AS, Stavanger (NO)

(72) Inventor: Olav Olsen, Stavanger (NO)

(73) Assignee: Torsion Tool Company AS, Stavanger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 17/238,650

(22) Filed: Apr. 23, 2021

(65) Prior Publication Data

US 2021/0238930 A1 Aug. 5, 2021

Related U.S. Application Data

(63) Continuation of application No. 16/482,485, filed as application No. PCT/NO2018/050025 on Jan. 30, 2018, now Pat. No. 11,015,399.

(30) Foreign Application Priority Data

Jan. 31, 2017 (NO) ..... 20170150
Jan. 15, 2018 (NO) ..... 20180062

(51) Int. Cl.
*E21B 17/042* (2006.01)
*E21B 19/16* (2006.01)

(52) U.S. Cl.
CPC ..... *E21B 17/042* (2013.01); *E21B 19/16* (2013.01)

(58) Field of Classification Search
CPC ..... E21B 17/042; E21B 19/16
See application file for complete search history.

(56) References Cited

U.S. PATENT DOCUMENTS 2,296,198 A 9/1942 Boynton
3,923,324 A 12/1975 Cruickshank et al.
(Continued)

FOREIGN PATENT DOCUMENTS

GB 2064041 A 6/1981
GB 2113334 A 8/1983
(Continued)

OTHER PUBLICATIONS

International Search Report for PCT Application No. PCT/NO2018/050025, dated Apr. 18, 2018 in 3 pages.
(Continued)

*Primary Examiner* — Taras P Bemko
(74) *Attorney, Agent, or Firm* — Knobbe, Martens, Olson & Bear, LLP

(57) ABSTRACT

A coupling assembly for elongate elements includes a pin having an outward-facing pin surface, and a box having an inward-facing box surface. The pin surface and box surface are configured for mating engagement. At least one bore has a port configured for connection to an injection fluid reservoir as a first opening and a second opening penetrating the pin surface or the box surface. A region of the box surface can include a wall thickness less than the thicknesses of the adjacent box walls. A region of the box surface can also include a material of a lower mod ulus of elasticity than the material of a corresponding region of the pin surface, or vice versa. A region of the pin surface can include a wall thickness which is less than the thicknesses of the adjacent pin walls.

16 Claims, 10 Drawing Sheets

(56) References Cited

U.S. PATENT DOCUMENTS

| | | | | |
|---|---|---|---|---|
| 4,561,683 | A | 12/1985 | Lumsden et al. | |
| 4,648,627 | A * | 3/1987 | Reimert | E21B 17/042 285/91 |
| 4,830,408 | A | 5/1989 | Reimert | |
| 6,485,061 | B1 * | 11/2002 | Mosing | E21B 17/08 285/333 |
| 7,011,344 | B1 * | 3/2006 | Bakke | E21B 17/04 285/354 |
| 2004/0065446 | A1 | 4/2004 | Tran et al. | |
| 2011/0147009 | A1 | 6/2011 | Dupal et al. | |
| 2012/0049513 | A1 | 3/2012 | Herrera | |
| 2015/0368986 | A1 * | 12/2015 | Narikawa | E21B 17/042 166/380 |

FOREIGN PATENT DOCUMENTS

| | | | |
|---|---|---|---|
| GB | 2113335 | A | 8/1983 |
| GB | 2180312 | A | 3/1987 |
| WO | WO 2005/061852 | A1 | 7/2005 |

OTHER PUBLICATIONS

Norwegian Search Report for Application No. 20170150, dated Sep. 6, 2017 in 2 pages.

Norwegian Search Report for Application No. 20180062, dated Aug. 14, 2018 in 2 pages.

* cited by examiner

COUPLING ASSEMBLY FOR ELONGATE ELEMENTS

CROSS-REFERENCE TO RELATED APPLICATIONS

This application is a continuation of U.S. application Ser. No. 16/482,485, filed on Jul. 31, 2019 (now issued as U.S. Pat. No. 11,015,399) as the U.S. National Phase under 35. U.S.C. § 371 of International Application PCT/NO2018/050025, filed Jan. 30, 2018, which claims priority to Norwegian Patent Application No. 20170150, filed Jan. 31, 2017 and Norwegian Patent Application No. 20180062, filed Jan. 15, 2018. The disclosures of the above-described applications are hereby incorporated by reference in their entirety.

FIELD OF THE INVENTION

The invention relates to the field of couplings for connecting elongated elements, such as pipes, tubes, shafts and axles. More specifically, the invention concerns a coupling assembly, and a method of mating the coupling assembly.

BACKGROUND OF THE INVENTION

Pipe sections or tubular sections used for drilling deep wells in e.g. oil or gas reservoirs or geothermal formations, utilize long sections of drill pipe, well casing or tubing that usually have a tapered, exteriorly-threaded male end called a pin member. In use, the pin members are threaded into corresponding couplings, collars or integral female pipe sections; their threaded ends are called a box member. These box members have an interiorly-threaded tapered thread corresponding to their respective pin members.

A dominant type of pin-box connection has been the American Petroleum Institute (API) threaded and coupled connection that achieves its assembly with threads and torque shoulders. These tapered connections provide increasing bearing stresses to the seal between the pin member and box member with increasing engagement produced by rotational torque. It is well known in the petroleum industry that the performance of API and premium double shoulder connections are highly dependent on the make-up assembly (engagement) condition of the joint, and therefore it is important to determine if the joint is made-up properly. Assembly conditions include friction-related factors such as thread dope/lubrication, surface finishes, tong position and type/model, eccentricity, and impurities (dirt or rust). Hydraulic tongs, often referred to as an "iron roughneck", or manually operated tongs are normally used to make up connections between drill pipe, while so-called "casing tongs" are used to make up casing and production pipe (or liner).

As the well depths and lengths (as well as the number of long horizontal wells and directional wells) have increased, the drilling and production environment has become more demanding. For example, a well of 6000 meters may require as much as 7000 connections and disconnections of pipe, with varying torque. The threaded pin-box connections need to meet rigorous demands regarding pressure loss across the connection, tension/compression resistance, higher torque, and resistance to internal and external pressure. The threaded connections developed to meet these demands are referred to as "premium" connections and "double-shoulder connection" (DSC).

In a premium coupling, the externally-threaded member (i.e. the "pin") includes tapered threads, seal portions (i.e. metal to metal seal portions) and shoulders (e.g. torque shoulders) or these two combined. The internally-threaded member (i.e. the "box") also includes tapered threads, and seal portions and shoulders similarly to the pin. The tapered threads are important for quickly and firmly fixing the pipe joint, the seal portions play a role of ensuring fluid and gas tight by bringing the box and the pins into metal contact at such portions, and the shoulders form a shoulder faces which play a role of abutments during make-up of the coupling. Connecting ("making") and disconnecting ("breaking") a premium coupling requires higher torque than for an API coupling. A premium coupling normally has thinner wall thicknesses than the API coupling, among other reasons to reduce hydrodynamic drag around the outside portion of the coupling. These thinner wall thicknesses place an increased demand on the tongs in order to avoid coupling deformation. Due to the higher make-up torque, a premium connection must withstand higher radial clamp force from the iron roughneck during make and break.

So-called "extended-reach drilling" (ERD) places high demands on the couplings, in order to overcome friction loss between the drill string and the formation or casing, and the required torque (to rotate the drill string) increases with the length of the well. Circulating drill fluids in such long wells is also more complicated and demanding, as each connection represents a restriction in the annulus between the drill pipe and casing. Various means and methods exist for verifying proper abutment during mating as well as correct torque during make-up.

The prior art includes GB 2 064 041 A, which discloses a pipe connector for interconnecting pipe sections to form a pipe string for use in the drilling and/or completion of offshore oil or gas wells. The pipe connector comprises a tubular box member for connection to the end of a pipe and a tubular pin member for connection to the end of a pipe and which is telescopically receivable within the box member. The members have corresponding generally frusto-conical peripheral surfaces which overlie one another when the members are fully telescoped together. The surfaces comprise interengageable helical projection and groove means which extend therealong between end portions which are arranged to be a shrink fit one on the other. The members of the connector are engageable and releasable by the use of fluid under pressure which is injected between the frusto-conical surfaces when the members are partially interengaged. A radial clearance is provided between the crest and root surfaces of the projection and groove means along which the pressurized fluid can flow.

The prior art also includes U.S. Pat. No. 4,648,627, which discloses a connector assembly including a pin connector for receipt by a box connector. The pin connector features a neck portion having external threads, and the box connector features a collar portion having internal threads, generally complementary for meshing with the external threads. The connectors may be threadedly joined together by longitudinally inserting the pin connector into the box connector, whereupon the two connectors are mutually sealed at two locations on opposite sides of the internal and external threads to define, with the threads, an annular region. Application of fluid pressure to the annular region may radially expand the region to permit further insertion of the pin connector into the box connector to mutually align the internal and external threads. Release of the fluid pressure permits mutual meshing between the threads to threadedly connect the pin and box connectors. The connector assembly may be released by like application of fluid pressure to radially expand the annular region, or by mutual rotation between the pin and box connectors, to disengage the meshing between the internal and external threads.

While the above prior art includes threaded connections, various thread-less connectors also exist.

For example, US 2012/049513 A1 shows a thread-less connection for coupling segments of a pipe (e.g. drill pipe used in the drilling of wellbores) longitudinally end to end. The coupling includes a pin end having a groove for receiving a locking ring. A box end has a groove for receiving the locking ring therein when the pin end is inserted into the box end. The locking ring has an uncompressed diameter selected to exert lateral force on the groove in the box end when assembled to the pin end.

WO 2005/061852 A1 shows a method of connecting tubular elements, particularly pipe for strings to be used in oil and gas wells. The pin and box have complementary stepped profiles. The pin and box are compressed and/or expanded, respectively, by means of a swaging die head. A key issue in this publication is that—prior to assembly—one or both of the pin/box external surfaces are at least partially coated by plasma spraying with hard angular material.

US 2004/065446 A1 shows an expander tool for connecting two tubulars by expanding a first tubular into a second surrounding tubular within a wellbore. The lower casing string has been expanded using the expander tool into frictional contact with the inner wall of the upper casing string. A sealing member is optionally disposed on the outer surface of the lower string of casing. The sealing member serves to provide a fluid seal between the outer surface of the lower string of casing and the inner surface of the upper string of casing after the lower casing string has been expanded.

US 2011/147009 A1 shows a drill pipe connector assembly capable of connecting drill pipe segments without rotation. The assembly includes the pin end of a first drill pipe stabbed within the connector end of a second drill pipe. A connector nut is thread-connected or snap-locked to the connector end of the second drill pipe. The connector nut includes a retaining shoulder cooperating with a beveled shoulder on the pin end of the first drill pipe to retain the first drill pipe. The assembly includes seals to provide pressure integrity and prevent leaking. Cooperating rotational torque transfer profiles in the first and second drill pipes enable operational rotation of the drill string.

U.S. Pat. No. 3,923,324 A describes a drill collar for a rotary drill string, including a threadless drill collar body having pins being frictionally mounted by means of a shrink-fit on opposite ends of the body, to corresponding boxes of opposite subs. The frictional connection between the matching conical surfaces between conical pins of the drill collar body, and the corresponding subs, respectively, is accomplished as by the application of pressure fluid between the adjacent contacting surfaces, while simultaneously applying an axial force, as by fluid or hydraulic pressure, to push or force the box shaped portion of each sub onto its companion conical pin of the drill collar body, until such box shaped member abuts a shoulder adjacent the connection of the conical pins with the main drill collar body. A port is provided in the box shaped portions of each sub for introduction of gaseous or hydraulic fluid pressure into the space between the box and pin, for laterally expanding the sub box during shrink-fitting thereof onto the corresponding pin.

GB 2 113 335 A describes a pipe connector comprising a tubular box member which is telescopically engageable with a tubular pin member, the members having corresponding frusto-conical inner and outer peripheral surfaces. To axially lock the member together, when they are fully telescoped together, the surfaces are provided with interengageable projections and grooves which have varying axial extents and spacings so that, as the members are telescoped together, in all intermediate positions of the members, there is sufficient contact between crests of the grooves and surfaces between the projections to prevent inadvertent engagement of a projection with a groove. The members may be fully engaged by the application of pressurized hydraulic fluid to the overlapped portions of the surfaces following initial contact, and may be disengaged in the same way, the pressurized fluid both expanding the box and/or contracting the pin to permit engagement and lubricating the crest surfaces of the projections and surfaces between the grooves to facilitate sliding of these surfaces over one another. For this purpose, the box member may be provided with a radial duct for connection to a source of pressurized hydraulic fluid. The duct opens inwardly of the box into the region of the frusto-conical surface of the box which is provided with the projections or grooves. To ensure that the hydraulic fluid is able to flow along the full extent of the overlapped portions of the surfaces of the members, axially extending grooves are provided in both the box member and the pin member, duct opening into groove in the box member. The pressurized fluid is only required to assist engagement of the members after initial contact has been made.

The prior art also includes GB 2 180 312 A, GB 2 113 334 A, and U.S. Pat. No. 4,561,683 A, describing configurations similar to those described above.

The prior art couplings are predominantly concerned with handling either torque or compression/tension. There is a need for an improved coupling, that is more reliable and efficient, and which offers more operational advantages over the prior art.

SUMMARY OF THE INVENTION

The invention is set forth and characterized in the main claim, while the dependent claims describe other characteristics of the invention.

It is thus provided a coupling assembly for elongate elements, comprising:

- a pin member having an outward-facing pin surface, and a box member having an inward-facing box surface, said pin surface and box surface configured for mating engagement, and
- at least one bore having as a first opening a port configured for connection to an injection fluid reservoir and a second opening penetrating the pin surface or the box surface;

characterized in that:

- the pin surface comprises a plurality of pin protruding portions separated by pin recessed portions, and
- the box surface comprises a plurality of box protruding portions separated by box recessed portions; and wherein a pin protruding portion is shaped and dimensioned to fit into a designated box recessed portion, and wherein a box protruding portion is shaped and dimensioned to fit into a designated pin recessed portion.

This key-and-lock feature (hereinafter referred to as "Key-Loc") ensures that all ring-and-recess pairs must be aligned before the initial mating is complete.

In one embodiment, the pin and box members comprise complementary and respective frusto-conical pin and box mating surfaces.

In one embodiment, one or more portions of the surfaces are plain surfaces without helical threads or other pronounced protrusions configured for mating engagement. In one embodiment, one or more portions of the surfaces comprise a textured finish in order to augment static friction between the surfaces when the surfaces are connected.

The pin protruding portions, pin recessed portions, box protruding portions and box recessed portions are preferably circular portions, extending around the respective surface. The mating surfaces may comprise single frusto-conical sections, but may also comprise several frusto-conical sections with different taper angles in order to obtain an optimally distributed contact pressure between the mating surfaces.

The "Key-Loc" concept contributes to the axial/tensile strength and/or torque performance, as well as positioning of the connected coupling, of the connected coupling. In addition, the "Key-Loc" concept contributes to avoiding progressive failure mechanisms, such as micro-slip, from occurring under repetitive loading cycles, especially in a so-called "dog leg" situation during directional drilling.

In one embodiment, the axial widths of the pin portions decrease in the direction towards a pin member free end, and the axial widths of the box portions increase in the direction towards a box member free end. The larger widths are associated with the larger diameter of the frusto-conical shape of the pin and box surfaces, and the smaller widths are associated with the smaller diameter of the frusto-conical shape of the pin and box surfaces.

In one embodiment, the coupling assembly comprises a friction-enhancing device, configured for being arranged on the pin surface. The pin surface may comprise a plurality of stepped surfaces of diminishing surface radius towards the pin free end, and the box surface may comprises a plurality of stepped surfaces of increasing surface radius towards the box free end.

In one embodiment, a region of the box surface comprises a wall thickness which is less than the thicknesses of the adjacent box walls. Also, a region of the pin surface may comprise a wall thickness which is less than the thicknesses of the adjacent pin walls.

In one embodiment, a region of the box surface comprises a material of a lower modulus of elasticity than the material of a corresponding region of the pin surface, or vice versa.

In one embodiment, at least a portion of the pin and box mating surfaces comprise grooves. The grooves may extend in a double-helical formation.

It is also provided a method of mating the invented coupling assembly, characterized by:

a) performing an initial mating step until a cavity is formed between the first and second mating surfaces;

b) injecting a fluid under pressure into the cavity, and maintaining the fluid pressure while exerting an axial force to push the first and second mating members a predetermined distance towards each other;

s c) releasing the fluid pressure.

In one embodiment, the fluid pressure and axial force in step b) are balanced and controlled to ensure a predetermined elastic deformation and prevent plastic deformation in the mating members. Step a) may be performed until the pin and box gaskets or seals engage and facilitates the injection of a fluid between the pin and the box. The pin and box may comprise more than one seal, in order to maintain the sealing function when crossing a protrusion or recess.

Also, one or more injection channels may be located on the pin shoulder, to facilitate easy access and port protection during operation.

The invented coupling assembly may be connected and disconnected without rotational motion (as is necessary with a threaded connection), only axial motion and application of hydraulic pressure are required. The pin and box surfaces may be smooth or comprise complementary stepped profiles (protruding and recessed portions). Adhesion between the surfaces may be augmented by friction coating (e.g. electrode-less nickel coating with diamonds or similar), a serrated surface, particles in the injected fluid, "double-helix engravement" (fluid pressure distribution and friction particles distribution), separate friction sleeves, or/and by increasing surface roughness (by e.g. sandblasting or similar).

Besides the bias created by hydraulics and steel elastic properties, the friction factor between the pin and box will be decisive. The hydraulic fluid may be water or glue with or without a corrosion inhibitor, with or without particles, together with a surface structure or/and a separate friction shim, or/and an applied friction increasing coating, seeking the highest possible friction factor. The invented coupling exhibits improved performance over the prior art, in that it can handle combined torque, tension and compression.

The invented coupling assembly may be useful for connecting any elongated elements that may rotate and transfer torque; such as pipes, propeller shafts, axles, as well as various tubulars such as drill pipe (drill string) and casing for casing-drilling. The invented coupling assembly transfers torque equally well in both rotational directions (as opposed a prior art threaded coupling). This "bidirectional" torque capability is particularly useful is a drill pipe is jammed and it is necessary to counter-rotate to release the drill bit or other downhole tools. The coupling assembly may also be useful for non-rotating elongated elements, such as rods, different process pipe lines, borehole casings and liners.

In the prior art, connections between pipe joint having electrical (power, signals) cables (so-called "wired pipe", "powered pipe", or "intellipipe") are accomplished by elaborate rotatable connections or by inductive couplings. With the invention, the cables may be connected by a metal-to-metal connection, for example by embedded and electrically insulated metal portions in the pin free end and the box inward shoulder. Such "plug-and-socket" connection is possible with the invention, as the pipe joints need not rotate during the connection process, but merely move axially towards each other. The electrical connectors may also be used to verify that the connection has been completed.

The invention may also replace the prior art top drive-saver sub connection, which is time consuming to replace.

Well tractor: When installing well tractor modules, it is often not possible to rotate the pipe which makes up the barrier against pressure and other mechanical forces during operation, due to internal contacts and connections. With the invention, the prior art complex connection comprising a combination of sleeves, nuts and seals may be eliminated.

Also, in various bottom-hole assemblies and completions, the invention may replace all threaded connections. The axial movement of the invented coupling assembly will make design of connections and internal components much easier, as rotation is not required to make the connection. Furthermore, the invention may replace complex and time-consuming welding operations associated with the connection and laying of trunk lines and pipes, both on the seabed and on land.

The invention is suitable with any materials commonly used in pipes, propulsion shafts, axles, drill pipe (drill string), drilling risers, rods, borehole casings, liners, etc., such as stainless steel. However, the invented coupling also lends itself to the use of various steel grades (e.g. 100 ksi box and 130 ksi pin), light-weight materials, such as fibrereinforced composites, titanium, aluminum and similar alloys. That is, both the coupling and the associated elongated elements may be made of such materials (or in combination). This will allow for a significant weight reduction of e.g. drill strings, compared to the steel drill strings of the prior art.

BRIEF DESCRIPTION OF THE DRAWINGS

These and other characteristics of the invention will become clear from the following description of a preferential form of embodiment, given as a non-restrictive example, with reference to the attached schematic drawings, wherein.

DETAILED DESCRIPTION OF EMBODIMENTS

Figure 1:
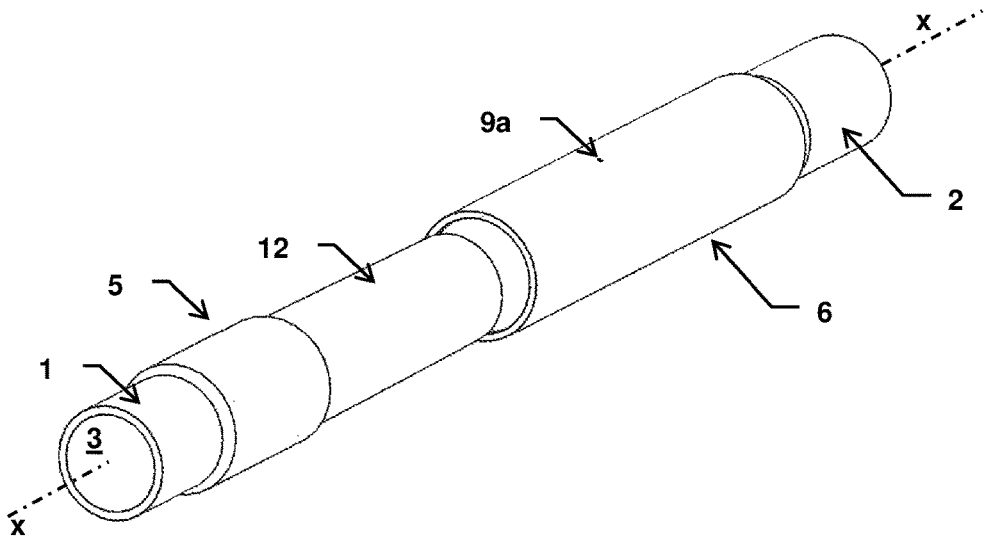
FIG. 1 is a perspective view of a first embodiment of the coupling assembly according to the invention, in a disconnected state.

The following description will use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

Figure 2:
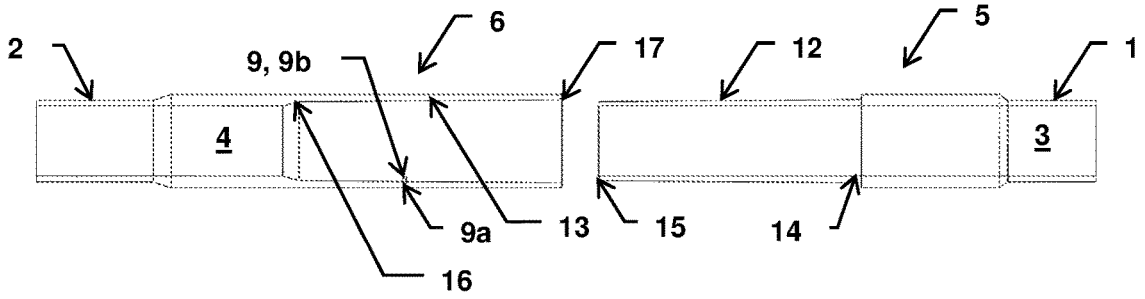
FIG. 2 is a sectional view of the coupling assembly shown in FIG. 1, in a plane along the longitudinal central axis x-x, in a disconnected state.

Referring initially to FIG. 1 and FIG. 2, the invented coupling assembly comprises a first mating member 5 and a second mating member 6. In the illustrated embodiment, the first mating member is a pin member 5 which forms an end portion of a first pipe 1 having an internal bore 3. The second mating member is a box member 6 which forms an end portion of a second pipe 2 having an internal bore 4. It should be understood that only a part of the first and second pipes 1,2 are shown, and the skilled person will understand that these pipes may be several meters long. The pipes 1,2 may for example be drill pipes, liners, casing joints or other tubular elements configured for rotational movement and for conveying a fluid. In fact, although not illustrated, the pipes may be replaced by other elongated elements such as shafts and axles. The invention shall therefore not be limited to a coupling assembly for tubular elements, but be applicable to a coupling assembly for any elongated elements. For the purpose of this description, however, the elongated elements 1,2 will be referred to a tubulars 1,2.

The pin member 5 comprises a first mating surface 12, hereinafter also referred to as a pin surface 12, here in the shape of a frusto-conical surface facing outwards with respect to the central axis x-x. The pin surface ends at a pin shoulder 14.

The box member 6 comprises a second mating surface 13, hereinafter also referred to as a box surface 13, here in the shape of a frusto-conical surface facing inwards with respect to the central axis x-x. The box surface ends at an internal box shoulder 16.

Such pin-and-box shapes are per se well known in the art, and need therefore not be described in further detail here. Seals (not shown) may be arranged at the pin shoulder 14 and the pin free end 15, or (more common) at the pin free end 15 and the box inner shoulder 16. The seals may be integrated (as profiles in the pin and/or box) or may be removable, and may comprise materials such as elastomers and/or metals. It should be understood, however, that the pin-and-box coupling may also be used without seals.

In the embodiment illustrated in FIGS. 1-5, the pin surface 12 and box surface 13 are plain surfaces, without helical threads or other pronounced protrusions configured for mating engagement.

The pin and box surfaces are thus generally smooth, but may comprise a textured finish (roughness) of a certain topography in order to augment static friction (and hence adherence) between the pin and box when connected. Such topography may be obtained by friction coating (by for example nickel coating with diamonds) or by increasing surface roughness through sandblasting or similar. Although not illustrated, the pin and/or box surfaces, or portions of these surfaces, may be furnished with serrations in order to increase the torque capacity of the connected coupling.

Figure 15:
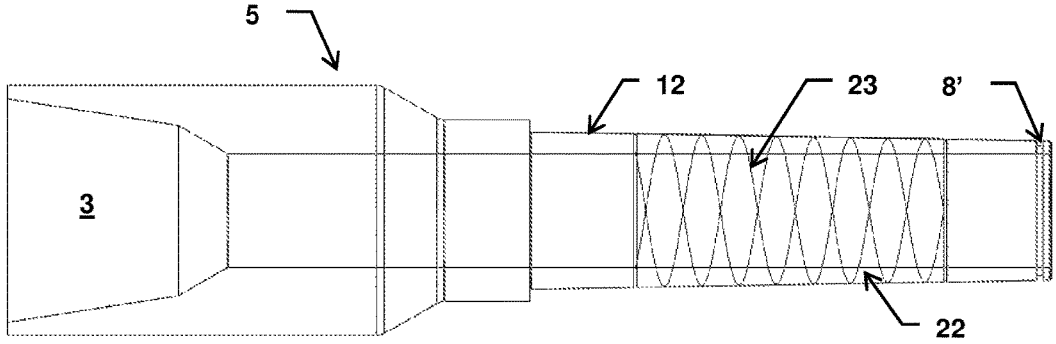
FIG. 15 shows an embodiment of a pin surface.

Another adherence-enhancing topography is illustrated in FIG. 15. Here, the frusto-conical pin surface 12 is provided with grooves 23, extending in a double-helical formation 22. It should be understood that the grooves preferably are quite shallow in relation to the dimensions of the pin and box. As a non-limiting example, the groove 23 depth may be on the order of one tenth of a millimeter for a pin having an outer diameter (OD) of 120 mm Although not illustrated, it should be understood that a double-helix may also be formed in the box surface, either in lieu of the double-helical formation 22 or as supplement to it. The helical grooves serve two functions, by providing a) fluid distribution channels during mating and b) distribute friction-enhancing fluid with particles.

Figure 6:
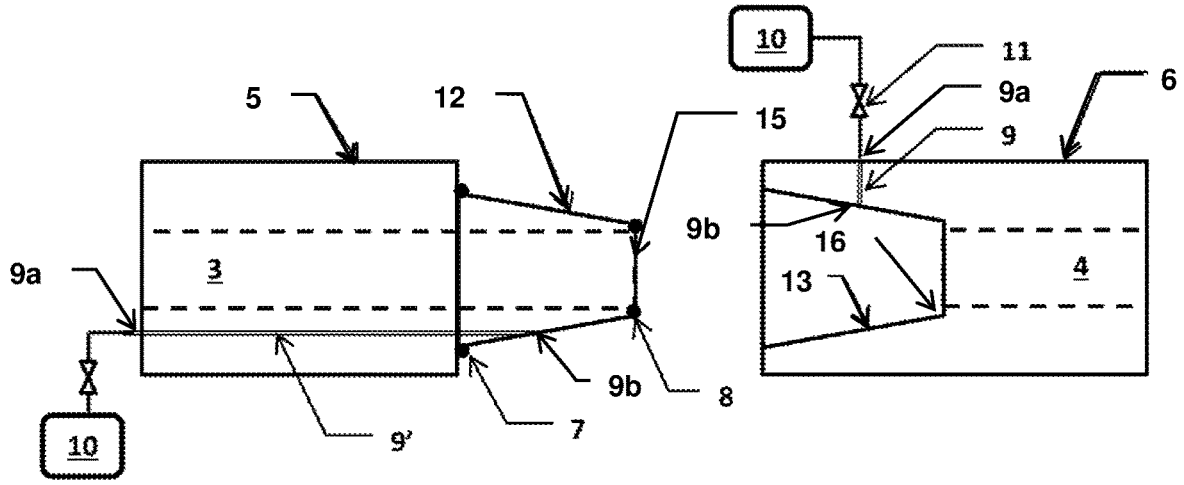
FIG. 6 is a schematic sectional view of an embodiment of the coupling assembly according to the invention, in a plane along a longitudinal central axis, in a disconnected state.
Figure 16:
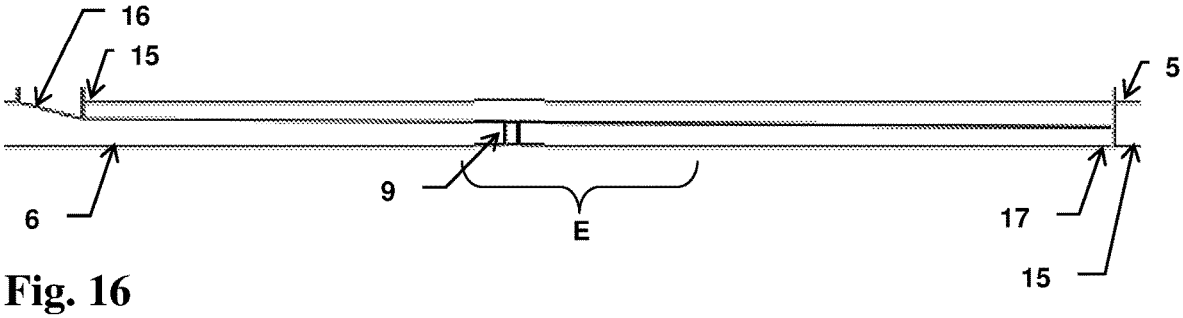
FIG. 16 an enlarged view of the section marked "A" in FIG. 4.

Referring again to FIG. 1 and FIG. 2, arranged in the external wall of the box member 6 is an opening (a port) 9*a* which is the outward opening of a bore 9 extending through the box member wall and into the box member interior, penetrating the box surface 13 in an inward opening 9*b* (another illustration of the bore 9 is provided in i.a. FIG. 6 and FIG. 16). The bore 9 therefore provides a fluid access channel into the box. It should be understood that although only one bore 9 is shown in the figures, a practical embodiment of the invention may comprise several bores.

Figure 3:
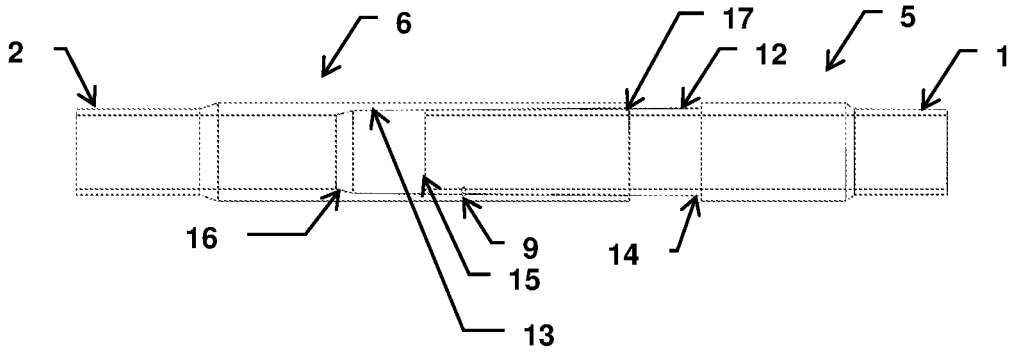
FIG. 3 corresponds to FIG. 2, but shows the coupling assembly in a partly connected state.
Figure 4:
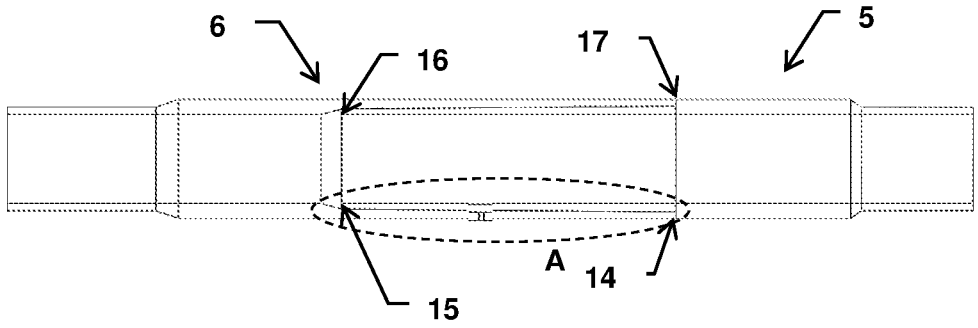
FIG. 4 corresponds to FIG. 3, but shown the coupling assembly in a connected state.
Figure 5:
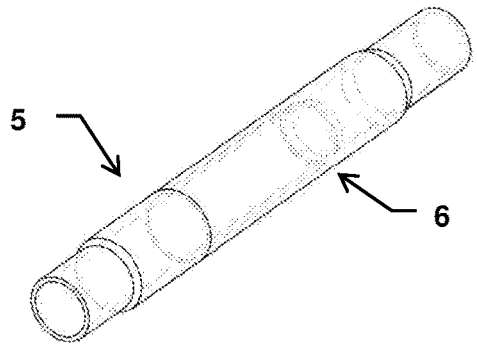
FIG. 5 is a perspective and transparent view of the coupling assembly shown in FIG. 1, in a connected state, i.e. corresponding to the state shown in FIG. 4.

FIG. 3 illustrates an initial step in a mating process of the pin-and-box coupling shown in FIG. 1 and FIG. 2, in which the pin member 5 has been inserted a distance into the box member 6. FIG. 4 and FIG. 5 illustrate the state in which the mating process has been completed and the connection between the pin member and box member has been made.

FIG. 6 illustrates an embodiment of the invention that in principle is similar to the embodiment described above with reference to FIGS. 1-5. In addition, however, FIG. 6 shows how seals 7, 8 are arranged in the region of the pin shoulder and pin free end, respectively. It should be understood that the seals may be arranged on the box instead, and that a combination of the two arrangement is conceivable. The seals serve to form a frusto-conical annular cavity during the initial mating, to contain injected fluid. FIG. 6 also shows how a pressurized fluid reservoir 10 is connected to the bore 9 via a conduit 10*a*. The reservoir 10 preferably contains a liquid, such as (but not necessarily limited to) water, which may be injected under pressure into the box member 6, controlled via the control valve 11. FIG. 6 also illustrates an alternative configuration in which the reservoir 10 is connected to a bore 9' which extends through the pin member 5 body, and where the bore 9' penetrates the pin surface 12 with the opening 9*b*. The effect of this configuration is equivalent to the configuration in which the bore 9 extends through the box member 5 wall inasmuch as both bore configuration deposit the injected fluid at more or less the same location during a mating operation. However, connecting the reservoir 10 to the bore 9' extending through the pin member 5 body may have certain operational advantages.

Referring additionally to FIG. 16, which shows an enlargement of the section marked "A" in FIG. 4, the wall thicknesses of the pin and box, respectively, correspond inversely in the illustrated embodiment. That is, the wall thickness of the pin free end 15 corresponds (i.a. is more or less equal) to the wall thickness of the box outer end 17, and the wall thickness of the pin rear end (in the region immediately before the pin shoulder 14) corresponds to the wall thickness of the box rear end (in the region immediately before the box shoulder 16).

Figure 7:
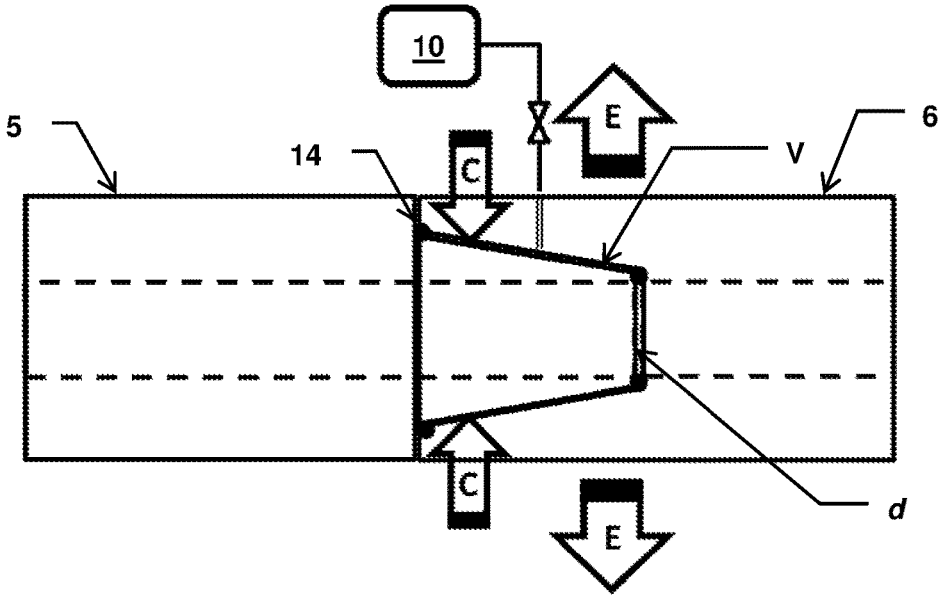
FIG. 7 corresponds to FIG. 6, and illustrates a method of connecting the pin member and box member.
Figure 8:
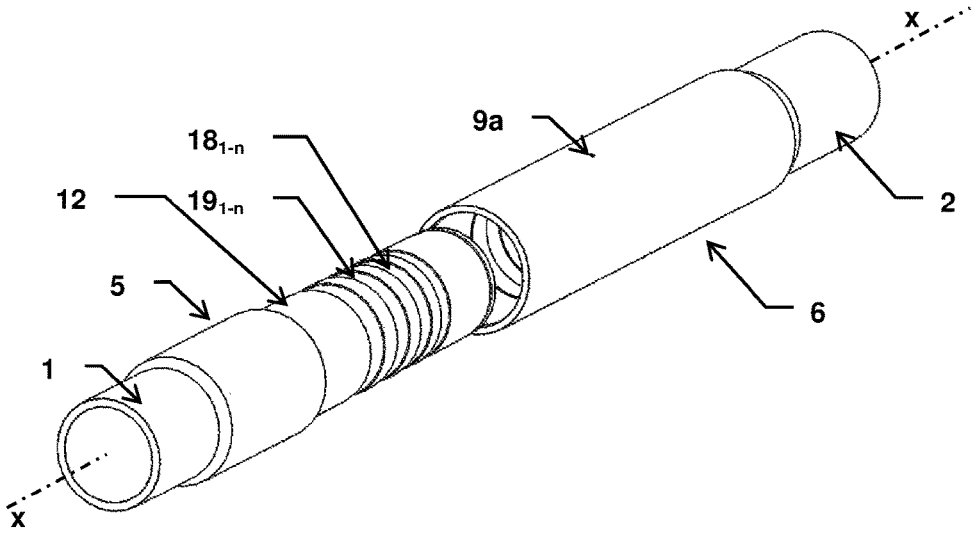
FIG. 8 is a perspective view of a second embodiment of the coupling assembly according to the invention, in a disconnected state.
Figure 9:
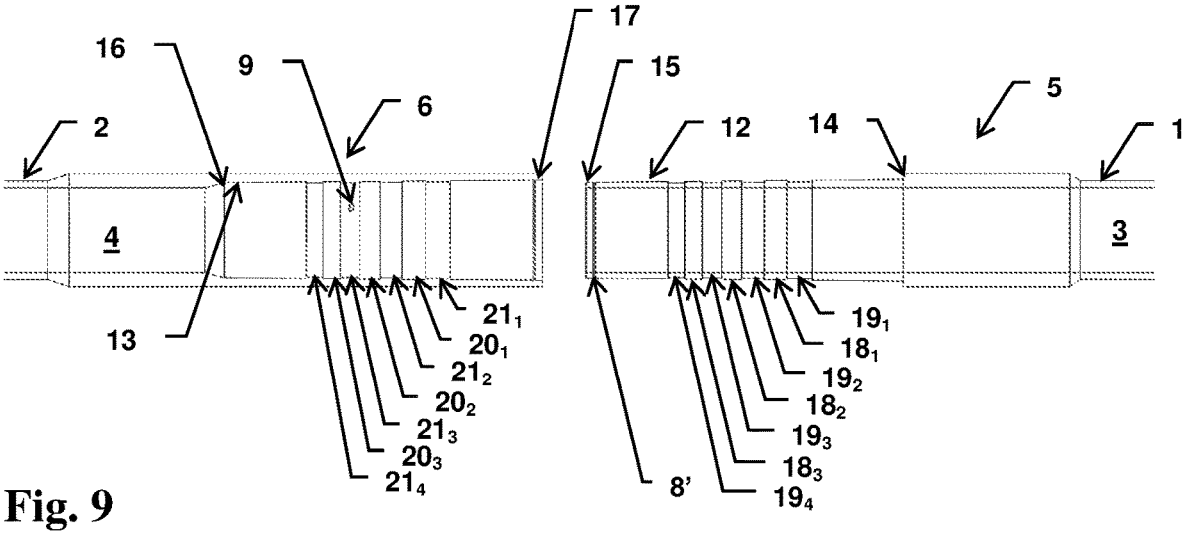
FIG. 9 is a sectional view of the coupling assembly shown in FIG. 8, in a plane along the longitudinal central axis x-x, in a disconnected state.
Figure 10:
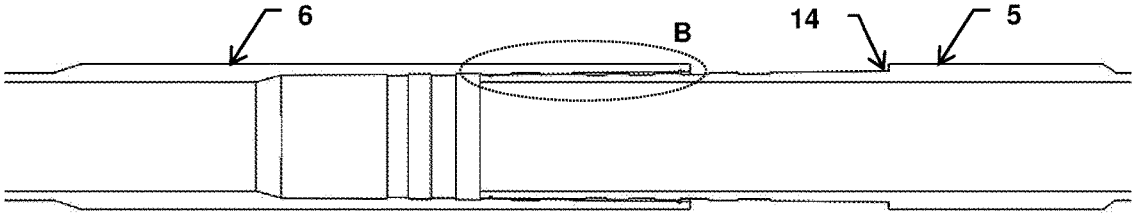
FIG. 10 corresponds to FIG. 9, but shows the coupling assembly in a partly connected state.
Figure 11:
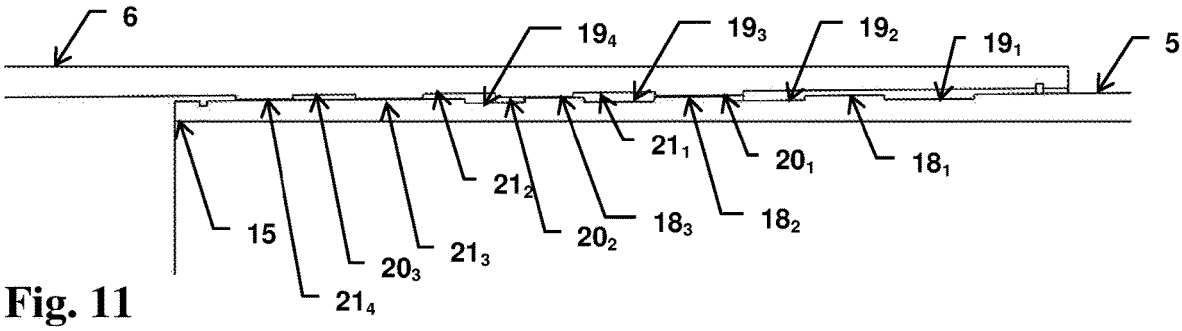
FIG. 11 is an enlarged view of the section marked "B" in FIG. 10.
Figure 12:
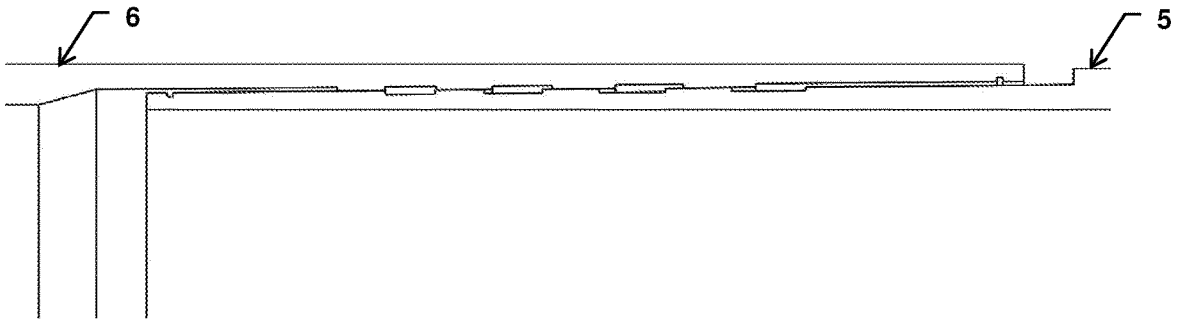
FIG. 12 corresponds to FIG. 11, but shows a state in which the coupling assembly has been further connected.

A mating process will now be described in more detail, with reference also to FIG. 7, in addition to FIG. 6. In FIG. 7, the pin member 5 and box member 6 have been moved together in an axial movement (i.e. no rotation necessary), a pressurized hydraulic liquid (e.g. water) is injected from the reservoir 10 through the bore 9 (or bore 9') when the seal 7 and the seal 8 have created a cavity V between the pin surface 12 and the box surface 13. This cavity V, which essentially is an annular, frusto-conical, cavity, is very small compared to the dimensions of the pin and box surfaces and therefore only appears as a solid black line in FIG. 7. The fluid pressure inside the cavity V causes elastic deformation in the pin member and box member, such that the box member wall expands radially (see arrows "E" in FIG. 7) and the pin member is compressed radially (see arrows "C" in FIG. 7). This deformation allows the pin member to be inserted an additional distance d into the box member. At the stage where the box free end 17 meets the shoulder 14 on the pin member, the fluid pressure is released, causing the pin and box members to resume their original shape and thus forming a tight and high-tension connection.

FIGS. 8-14 illustrate a second embodiment of the invented coupling assembly. This embodiment has several similarities to the embodiments described above with respect to FIGS. 1-7 (and may thus be combined with that embodiment), but exhibits an additional feature that the pin surface 12 and box surface 13 each comprise radially protruded portions and radially recessed portions. More specifically, referring initially to FIG. 9, the pin surface 12 comprises successive (in the axial direction) circular and radially protruding portions $\mathbf{18}_{1\text{-}3}$ (hereinafter referred to as "pin rings") and circular and radially recessed portions $\mathbf{19}_{1\text{-}4}$ (hereinafter referred to as "pin recesses"). Reference number 8' denotes a seal groove, in which a seal (not shown) may be arranged as described above with reference to FIG. 6. It should be understood that metal seals (embedded or inserted) may also be used, a purpose being to form a frusto-conical annular cavity into which fluids may be injected.

The box surface 13 comprises successive (in the axial direction) circular and radially protruding portions $\mathbf{20}_{1\text{-}3}$ (hereinafter referred to as "box rings") and circular and radially recessed portions $\mathbf{21}_{1\text{-}4}$ (hereinafter referred to as "box recesses"). It should be understood that the number of rings and recesses shown in the figure is an example only; as the invention is equally applicable to any number (i.e. also one) of rings and recesses.

Figure 14:
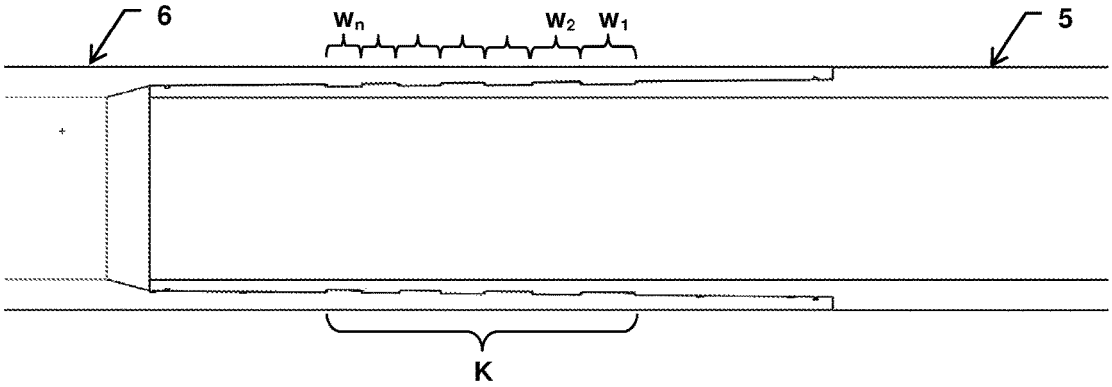
FIG. 14 corresponds to FIG. 9, but shows a state in which the coupling assembly has been fully connected, i.e. corresponding to the state shown in FIG. 13.

As is readily apparent from the figures, the axial widths of the pin rings $\mathbf{18}_{1\text{-}3}$ and pin recesses $\mathbf{19}_{1\text{-}4}$ decrease in the direction towards the pin free end 15; that is, the widths are greater in the region of the pin shoulder 14 than in the region of the pin free end 15. Conversely, the axial widths of the box rings $\mathbf{20}_{1\text{-}3}$ and box recesses $\mathbf{21}_{1\text{-}4}$ increase in the direction towards the box free end 17; that is, the widths are smaller in the region of the box inner shoulder 16 than in the region of the box free end 17 (opening). This is illustrated in FIG. 14, in which $w_1$ represents the largest width, $w_2$ represents a width smaller than $w_2$, and $w_n$ represents the smallest width. Thus, the larger widths are associated with the larger diameter of the frusto-conical shape of the pin and box surfaces, and the smaller widths are associated with the smaller diameter of the frusto-conical shape of the pin and box surfaces.

Figure 13:
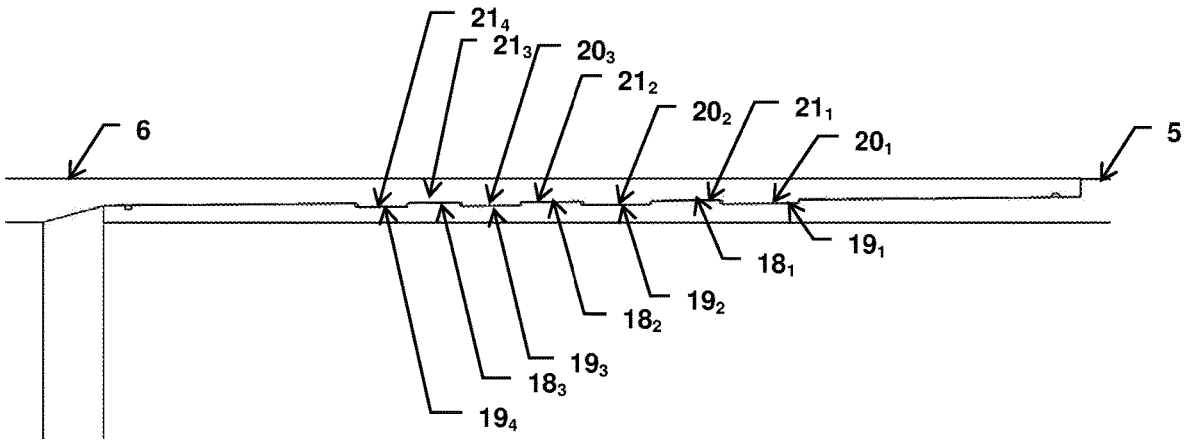
FIG. 13 corresponds to FIG. 11 but shows a state in which the coupling assembly has been fully connected.

The rings and recesses serve as individual abutment surfaces. Any pin ring $18_n$ is shaped and dimensioned to fit with a designated box recess $21_n$ and any box ring $20_n$ is shaped and dimensioned to fit with a designated pin recess $19_n$. This is illustrated in FIG. 13. Such key-and-lock concept (hereinafter referred to as "Key-Loc") ensures that all ring-and-recess pairs must be aligned before the initial mating is complete. The regions on the pin and box furnished with the above-mentioned rings and recesses will thus be referred to as "Key-Loc" regions K (see e.g. FIG. 14). The "Key-Loc" concept contributes to the axial/tensile strength and/or torque performance of the connected coupling. In addition, the "Key-Loc" concept contributes to avoiding progressive failure mechanisms, such as micro-slip, from occurring under repetitive loading cycles, especially in a so-called "dog leg" situation during directional drilling.

Figure 17:
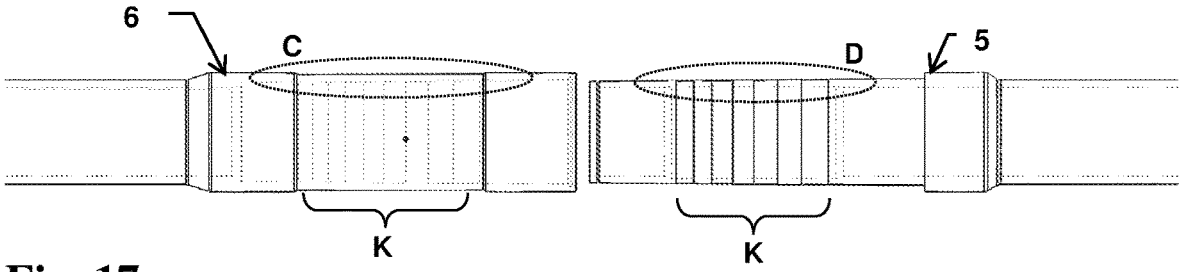
FIG. 17 is a transparent side view of an alternative embodiment of a box and pin, in which portions of the pin and the box have a reduced wall thickness.
Figure 18A:
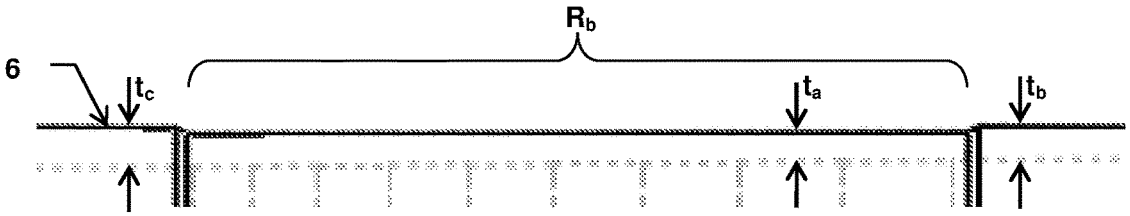
FIG. 18*a* is an enlarged view of the section marked "C" in FIG. 17.
Figure 18B:
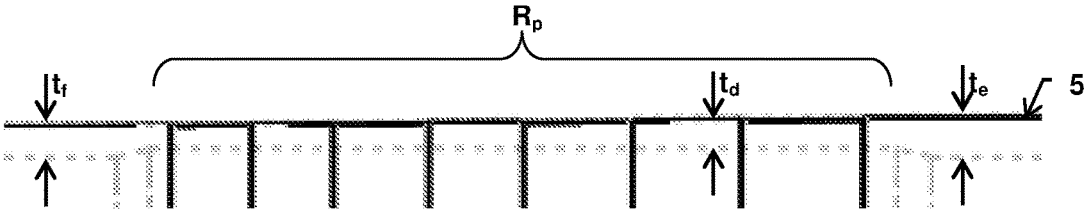
FIG. 18*b* is an enlarged view of the section marked "D" in FIG. 17.

In the embodiment illustrated in FIGS. 17, 18*a* and 18*b*, portions of the pin 5 and box 6 are (in the region of the respective surfaces 12, 13) formed with wall thicknesses that are thinner than the wall thicknesses of adjacent portions. In these figures, the region $R_b$ of the box 6 has a wall thickness $t_a$ which is less than the thicknesses $t_b$, $t_c$ of the adjacent box walls. Similarly, the region $R_p$ of the pin 5 has a wall thickness $t_d$ which is less than the thicknesses $t_e$, $t_f$ of the adjacent pin walls. It should be noted that $t_a$ and $t_d$ do not have to be constant. It should be noted that the regions $R_b$, $R_p$ of reduced wall thickness generally correspond with the respective pin and box contact surfaces (e.g. reference numbers 12, 13; cf. above described embodiments). In FIGS. 17, 18*a* and 18*b*, the regions $R_b$, $R_p$ correspond to the above-mentioned pin and box "Key-Loc" regions. It will be understood that the walls of reduced thickness ($t_a$, $t_d$) will deform elastically relatively more than the adjacent walls when fluid is applied between the pin and box to make or break a connections as described above with reference to FIGS. 6 and 7. This "ballooning" effect is particularly advantageous as the enhanced elastic deformation in these regions allows the "Key-Loc" rings and recesses to be more pronounced (i.e. taller and deeper) that what is possible if the wall thicknesses are uniform. Although not illustrated, it should be noted that a similar elastic deformation ("ballooning" effect) may be achieved if the material in the region $R_b$, comprises a material of a lower modulus of elasticity than that of a corresponding region $R_p$ of the pin. It will be understood that such material properties may be combined with the reduced wall thicknesses. Although not illustrated, it should be understood that the "ballooning" effect may be achieved (although to a lesser extent) if only the pin or the box is furnished with such regions of reduced wall thickness.

Figure 19A:
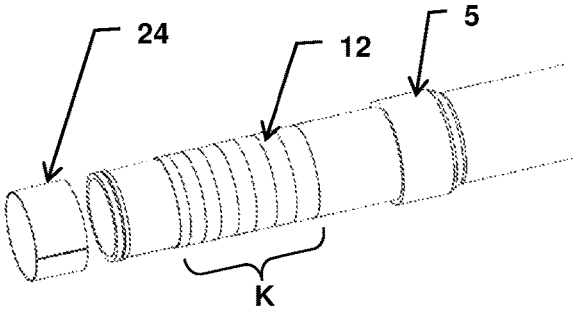
FIG. 19*a* is a perspective view of an embodiment of the invented pin, in association with a friction sleeve.
Figure 19B:
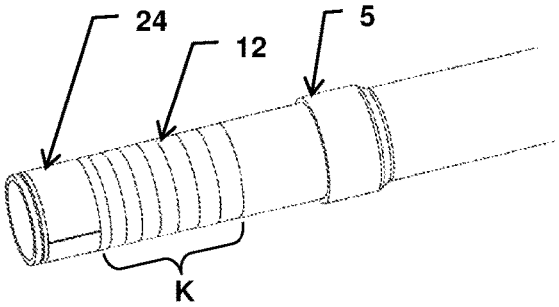
FIG. 19*b* corresponds to FIG. 19*a*, and illustrates the friction sleeve fitted onto the end of the pin.

FIGS. 19*a* and 19*b* illustrate another friction-enhancing device, in the form of a friction sleeve 24 which may be arranged on the free end of the pin surface 12, outside of the "Key-Loc" region K. The friction sleeve may comprise a coating of a friction-enhancing materials (e.g. diamond coating) which per se is known in the art. The coating may be applied on both sides of the sleeve 24. Although FIGS. 19*a* and 19*b* illustrate the friction sleeve in conjunction with a pin and box having "Key-Loc" regions, it should be understood that the friction sleeve may be installed on other embodiments as well, for example the embodiment described above with reference to FIGS. 1-5.

Figure 20:
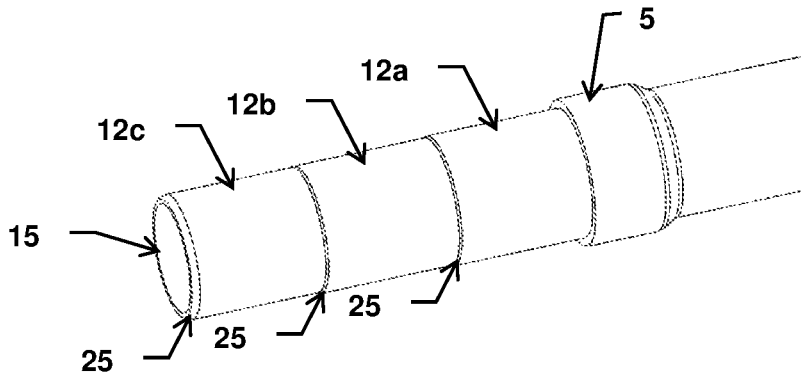
FIG. 20 is a perspective view of an alternative embodiment of the invented pin, having a stepped pin profile.

FIG. 20 illustrates an alternative embodiment of the invented pin, having a stepped pin surface, such that the pin surface radius is diminishing, in steps, towards the pin free end 15. In FIG. 20, three pin surfaces 12*a*, 12, 12*c* are shown, but it should be understood that more or fewer stepped surfaces are possible. The pin free end 15 and the transition between each step comprise a chamfered portion 25. Although not illustrated, it should be understood that the box surface will have a corresponding stepped surface. It should also be understood that the pin surfaces 12*a-c* may be cylindrical, or frusto-conical. In the latter case, the pin taper angles increase towards the pin free end, and the box taper angles decrease correspondingly. One or more of the pin surfaces may also comprise a "Key-Loc" region.

Figure 21:
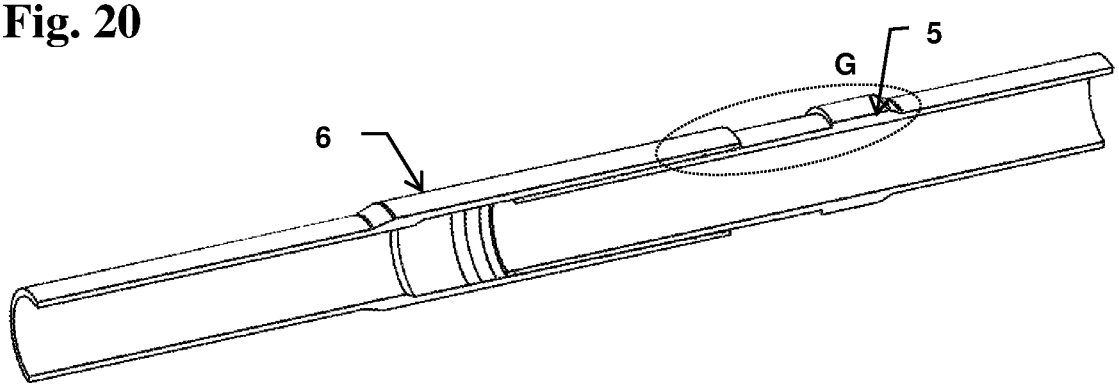
FIG. 21 is a sectional perspective view of an embodiment of a pin-and-box coupling having dual seals, in a partially interconnected state
Figure 22:
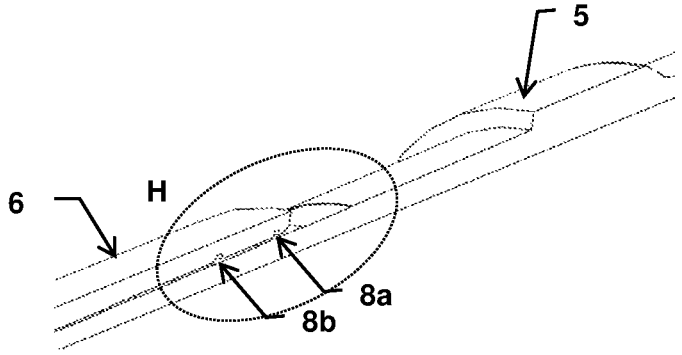
FIG. 22 is an enlarged view of the section marked "G" in FIG. 21.
Figure 23:
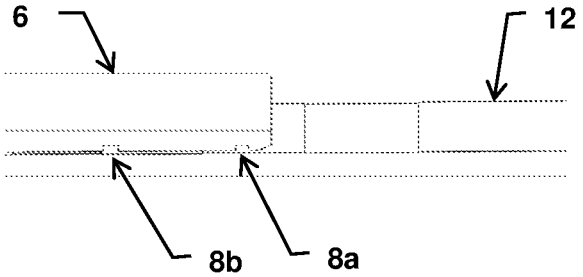
FIG. 23 is a side view of the section marked "H" in FIG. 22.

FIGS. 21, 22, 23 illustrate an embodiment of a pin-and-box coupling having dual seals. The figures illustrate two seal grooves 8*a*, 8*b* in the box surface (but it should be understood that a corresponding seal configuration may be incorporated in near the pin free end. It should also be understood that the figures illustrate the seal grooves only, but the skilled person will understand that appropriate seals may be installed in the grooves 8*a,b*. Seals may also be integrated in the pin and box, as described above. It should also be understood that more than two seals may be included. A purpose of the dual seals, which is particularly visible in FIG. 23, is to preserve the sealing function the pin (or box) slides across a protrusion ("ring") or recess.

Figure 24:
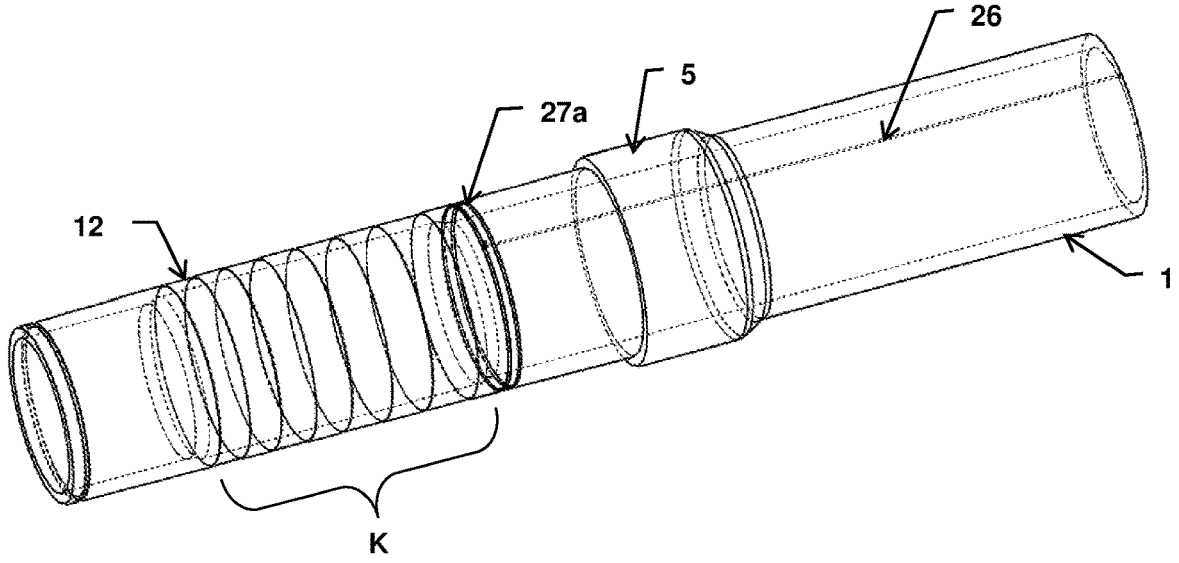
FIG. 24 is a transparent perspective view of an embodiment of the invented pin, illustrating wires or cables extending inside the pin body and an electrical contact surface.
Figure 25:
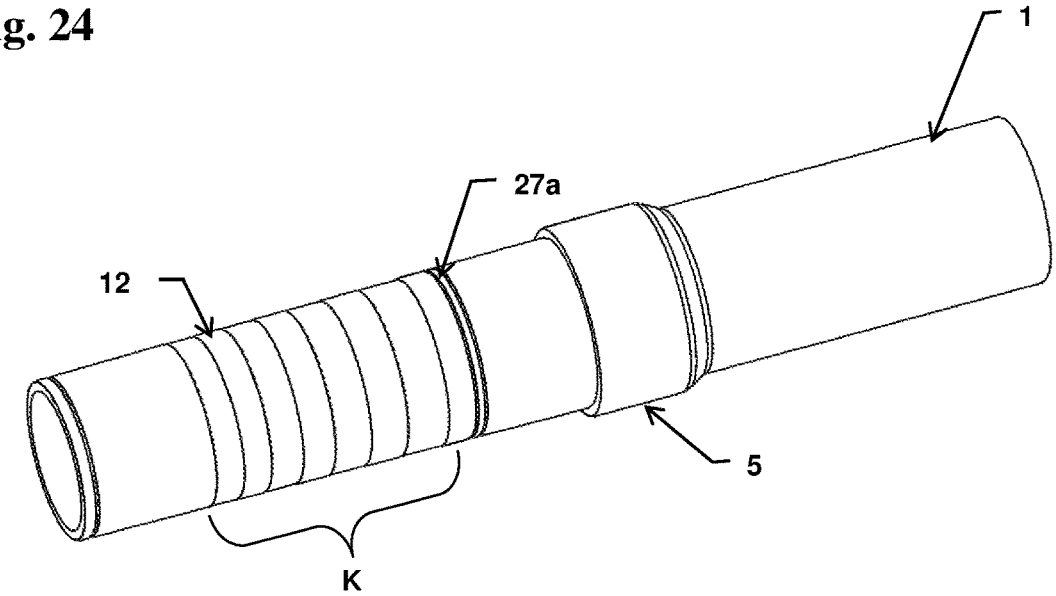
FIG. 25 is a perspective view corresponding to that of FIG. 24, illustrating an electrical contact surface.
Figure 26:
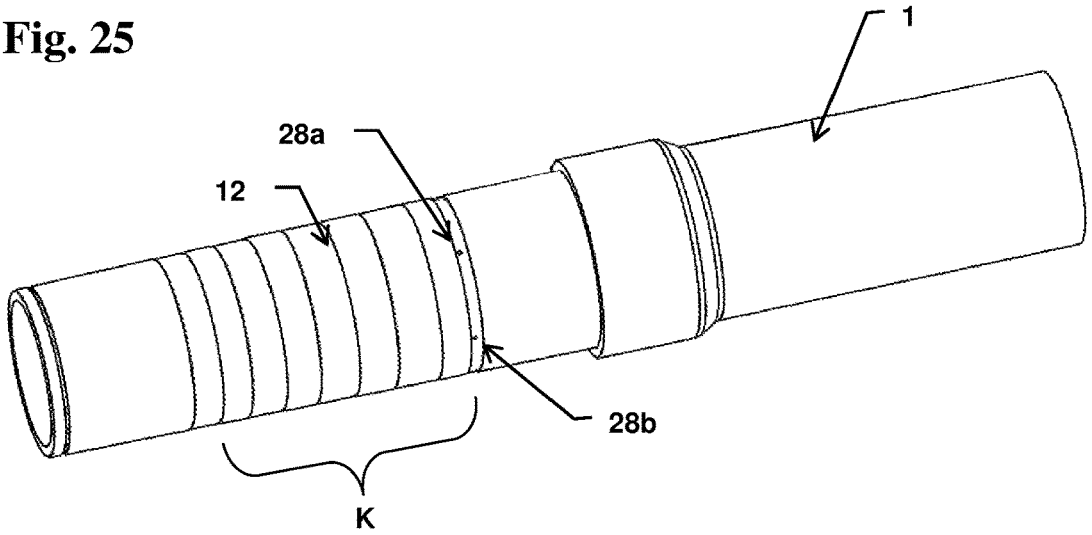
FIG. 26 is a variant of the embodiment illustrated in FIGS. 24 and 25, in which more than one wire may be connected to a contact surface.

FIGS. 24 and 25 illustrate an embodiment in which electrical wires 26 extending along the tubular (or shaft) 1 and terminating at a ring contact 27*a* on the pin 5 (a corresponding ring contact is arranged inside the box; not shown), The wires (or cables) may be connected by a metal-to-metal or plug-and-socket connection when the pin and box are mated. Although not illustrated, it should be understood that the contact rings may be arranged at one or more selected pin/box rings or recesses, whereby the electrical contacts may serve as a tool for verifying proper connection between the pin and box. FIG. 26 illustrates a similar configuration, illustrating how several wires (indicated as 28*a,b*) may be connected to a contact surface. It should be understood that a plurality of wires and contacts may be incorporated in the pin and box. It should also be understood that the wires may be embedded in the tubular wall or be arranged inside the tubular (or shaft).

The mating sequence of the embodiments of the coupling assembly described above, including the injection of pressurized hydraulic fluid in order to temporarily elastically deform the desired region of the pin member and box member, is performed as described above with reference to FIGS. 6 and 7.

In all of the embodiments described above, break-out is accomplished by applying a suitable liquid pressure through one (or more) of the conduits (9; 9') similarly to the procedure explained above, whereupon the pin may be released (and withdrawn) from the box.

In all of the embodiments described above, the invented coupling assembly is without conventional threads and therefore requires no rotation during connection or disconnection. The time required to connect and disconnect the coupling is therefore reduced significantly. By injecting the hydraulic fluid between the frusto-conical pin surface and box surface, elastic expansion of the box member and elastic compression of the pin member is accomplished, which enables a completion of the connection.

Concurrent with the injection of fluids, the pin and box are pushed further together. There should be a correlation between the axial forces, pushing the pin into the box, and the injection pressure, in order to create optimal conditions for the seals, pin member 5 and box member 6 and prevent plastic deformation of the coupling assembly. Thus, during the assembly procedure, the axial force (provided by handling tools) and the fluid injection pressure need to be balanced. Due to the frusto-conical shape of the coupling, an increase in the fluid injection pressure will cause an increased axial reaction (separation) force. To overcome the separation tendencies, a correlating axial assembly force must be applied. This assembly force will always have a predefined value which must be sufficient to overcome the separation force and to ensure that the seals engagement clearance is within design limits. The assembly data will be a part of the coupling operation verification.

When the pin and box surfaces meet and further advancement is not possible, due to contact between the pin member shoulder 14 and box free end 17, the hydraulic pressure between the pin and box surfaces is released, whereby the coupling is locked by means of circular preload and friction. Using the enveloping contact surface will remove restrictions associated with traditional API/DSC threaded connections. The invented coupling assembly will also allow the pipe joint cross-section to be reduced, as there is no need for traditional iron-roughneck, manual rig tongs or bucking units. On-site handling challenges are therefore mitigated.

The hydraulic friction coupling as described above will also allow drilling of significantly longer and deviated wellbores, as friction loss by circulating drilling fluid is reduced, and the torque capacity of the pipe joint is increased. The invented coupling assembly will also lower the sequence time (make/break) significantly and hence the cost of drilling.

What is claimed is:

1. A coupling assembly for elongate elements, comprising a pin having an outward-facing pin surface, and a box having an inward-facing box surface; said pin surface and box surface configured for mating engagement, and at least one bore having as a first opening a port configured for connection to an injection fluid reservoir and a second opening penetrating the pin surface or the box surface;

wherein:

a region of the box surface comprises a wall thickness which is less than the thicknesses of the adjacent box walls; and/or a region of the pin surface comprises a wall thickness which is less than the thicknesses of the adjacent pin walls; and/or a region of the box surface comprises a material of a lower modulus of elasticity than the material of a corresponding region of the pin surface, or vice versa, and wherein one or more portions of the surfaces comprise a textured finish in order to augment static friction between the surfaces when the surfaces are connected.

2. The coupling assembly of claim 1, wherein the pin and the box comprise complementary and respective frusto-conical pin and box mating surfaces.

3. The coupling assembly of claim 1, wherein the pin surface comprises a plurality of pin protruding portions separated by pin recessed portions, and the box surface comprises a plurality of box protruding portions separated by box recessed portions; and a pin protruding portion is shaped and dimensioned to fit into a designated box recessed portion, and wherein a box protruding portion is shaped and dimensioned to fit into a designated pin recessed portion.

4. The coupling assembly of claim 3, wherein the pin protruding portions, pin recessed portions, box protruding portions and box recessed portions are circular portions, extending around the respective surface.

5. The coupling assembly of claim 3, wherein the axial widths of the pin portions decrease in the direction towards a pin free end, and the axial widths of the box portions increase in the direction towards a box free end.

6. The coupling assembly of claim 5, wherein the larger widths are associated with the larger diameter of the frusto-conical shape of the pin and box surfaces, and the smaller widths are associated with the smaller diameter of the frusto-conical shape of the pin and box surfaces.

7. The coupling assembly of claim 1, further comprising a friction-enhancing device, configured for being arranged on the pin surface.

8. The coupling assembly of claim 1, wherein the pin surface comprises a plurality of stepped surfaces of diminishing surface radius towards the pin free end.

9. The coupling assembly of claim 1, wherein the box surface comprises a plurality of stepped surfaces of increasing surface radius towards the box free end.

10. The coupling assembly of claim 1, wherein the elongate elements comprise tubular elements such as drill pipes or wellbore casings, or axles or shafts.

11. The coupling assembly of claim 1, wherein at least a portion of the pin and box mating surfaces comprise grooves.

12. The coupling assembly of claim 11, wherein the grooves extend in a double-helical formation.

13. A method of mating the coupling assembly as defined by claim 1, comprising:

a) performing an initial mating step until a cavity is formed between the first and second mating surfaces;

b) injecting a fluid under pressure into the cavity, and maintaining the fluid pressure while exerting an axial force to push the first and second mating members a predetermined distance towards each other; and c) releasing the fluid pressure.

14. The method of claim 13, wherein the fluid pressure and axial force in step b) are balanced to ensure a predetermined elastic deformation and prevent plastic deformation in the mating members.

15. The method of claim 13, wherein step a) is performed until the pin and box gaskets or seals engage.

16. The coupling assembly of claim 1, wherein one or more portions of the surfaces are plain surfaces without helical threads or other pronounced protrusions configured for mating engagement, and wherein the region of the box surface that comprises a wall thickness that is less than the thicknesses of the adjacent box walls throughout the entire region and the region of the pin surface that comprises a wall thickness that is less than the thicknesses of the adjacent pin walls throughout the entire region.

* * * * *